United States Patent [19]

Kyto

[11] 4,065,111

[45] Dec. 27, 1977

[54] COVER FOR THE IGNITION CARRIAGE IN A SINTERING PLANT

[76] Inventor: Eero Kytö, Soukankuja 2 A 9, 02360 Espoo 36, Finland

[21] Appl. No.: 678,859

[22] Filed: Apr. 21, 1976

[30] Foreign Application Priority Data

Apr. 22, 1975 Finland ..... 751192

[51] Int. Cl.[2] ..... C21B 1/10

[52] U.S. Cl. ..... 266/138; 266/178

[58] Field of Search ..... 266/171, 178, 179, 180, 266/185, 138; 75/5

[56] References Cited

U.S. PATENT DOCUMENTS

| | | | |
|---|---|---|---|
| 82,576 | 9/1868 | Aitken | 266/185 |
| 1,348,408 | 8/1920 | Greenawalt | 266/185 |
| 2,527,311 | 10/1950 | Kelsey | 266/185 |
| 3,244,507 | 4/1966 | Linney | 266/178 |
| 3,460,818 | 8/1969 | Greaves et al. | 266/179 |
| 3,802,679 | 4/1974 | Schroeder | 266/138 |

*Primary Examiner*—Gerald A. Dost
*Attorney, Agent, or Firm*—Wigman & Cohen

[57] ABSTRACT

A cover for the ignition frame of a sintering apparatus is disclosed wherein the cover includes an enclosed space through which combustion air for the substantially horizontally disposed burners of the sintering apparatus is conducted. Combustion air delivered from a blower flows via a pipe to a central portion of the cover and into the enclosed space where it is preheated and cools the cover and thence flows to insulated pipes connected with the burners. In an alternate embodiment, two enclosed spaces are formed in the cover arranged in the direction of travel of a conveyor belt carrying the product to be sintered. The space arranged in the downstream direction of travel of the belt is provided with burners and the upstream space is provided with combustion air pipes.

7 Claims, 4 Drawing Figures

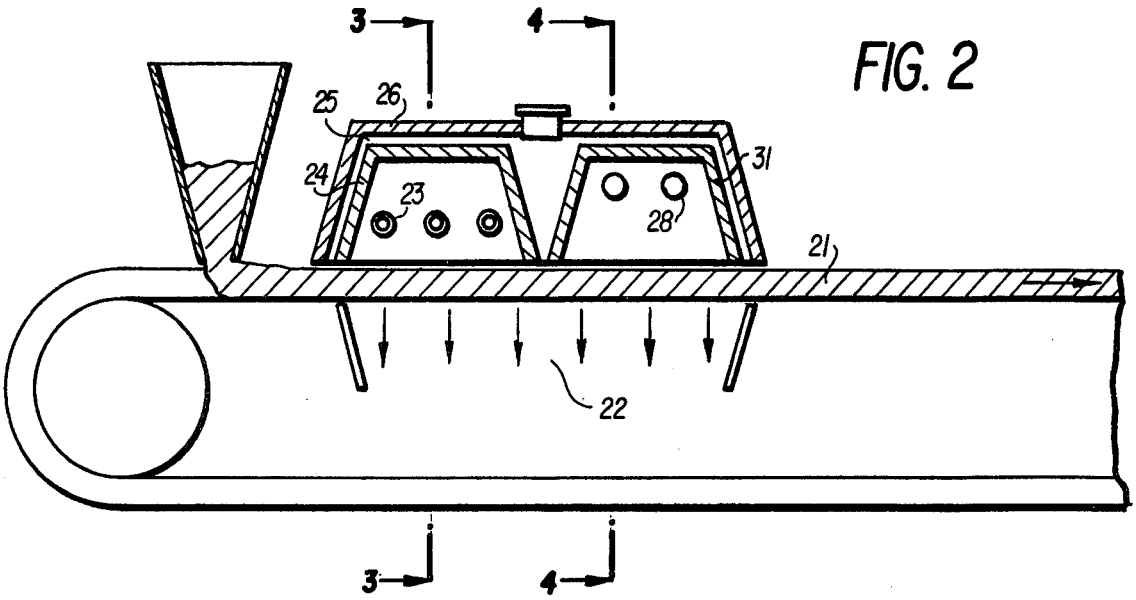
FIG. 2
FIG. 3
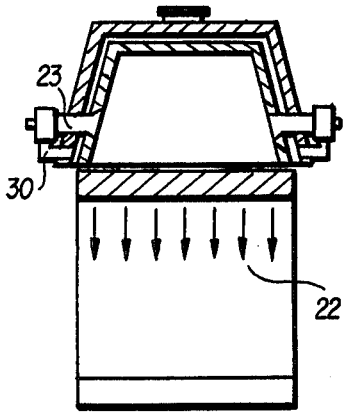
FIG. 4
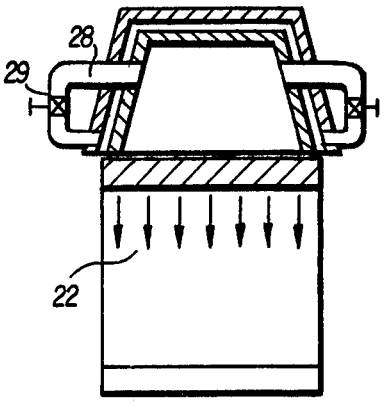

COVER FOR THE IGNITION CARRIAGE IN A SINTERING PLANT

BACKGROUND OF THE INVENTION

When fine ore is used in an iron blast furnace, this ore has to be converted into coarser form in order that it might be possible to charge the furnace with the ore. To this end, the ore is sintered in a separate sintering plant, often located immediately adjacent to the blast furnace. There are two fundamental types of sintering plants; belt sintering plants and pan sintering plants. In belt sintering plants, the sinter goods are supplied onto a moving grate, which transports the sinter goods through the different treatment steps. It is common practice to construct the grate of the belt sintering plant to have the shape of a conventional conveyor, but belts composed of consecutive grate carriages are also used.

In the Swedish Pat. No. 330,392, a belt sintering plant is disclosed wherein the belt has been made circular, whereby the construction may be somewhat simplified and the operating conditions improved from the user's point of view. In the same patent, a thorough clarification is also found of the different steps in the sintering process and of the design and advantages of the conventional belt sintering plant and of the circular belt sintering plant.

The pan sintering plant differs from the belt sintering plant in that the grates therein have been made stationary and the other treatment equipment has been made movable. The pan sintering plant may be provided with a straight or circular layout. Since the different components of a pan sintering plant are movable, they cannot be structurally designed to be as complex as those in a belt sintering plant, and the equipment of the different steps cannot be mutually connected. On the other hand, the design and structure of the pan sintering plant can be made considerably more simple and less space-consuming because it is possible to omit the belt, which is difficult to maintain in an operative condition, and to replace it by a few moving units performing the different treatment steps.

An essential component in the pan sintering plant is the ignition carriage, which moves above the grate to be positioned over each pan in its turn and ignites the sinter mixture. At present the ignition of the sinter goods takes place in two steps in the most modern designs: first, using the full power of the burners (usually oil burners) to ignite the sinter goods and, subsequently, using their partial power to maintain and equalize the burning. Since it is exceedingly awkward to connect any kind of gas pipes to the moving sintering carriage, the ignition is exclusively accomplished with the aid of oil, and the requisite combustion air is drawn from the air in the sintering plant with the aid of a blower and conducted to the burners by a separate pipe system. In all designs known in the prior art, because the cover must be simply constructed, a massive frame is used in the cover, consisting either totally of cast plates or of cast plates fitted and braced in a steel structure. The inner surface of the cover is provided with refractory masonry in order to prevent excessive heating of the frame. The greatest difficulty in a structure of this kind is its very great weight, considering that the cover moves on wheels along a track. On the other hand, even though a great thickness of insulating mass is used, the cover is still heated so much that it tends to warp in the course of time, with the consequence that the masonry develops cracks and the cover loses its tightness. Therefore, repairs and replacement of the cover are necessary from time to time.

SUMMARY AND OBJECTS OF THE INVENTION

The object of the present invention is to provide a cover for the ignition carriage which is lighter in construction and more durable and which at the same time improves the sintering process and thereby also the sintered goods obtained in the process.

The apparatus of the invention is characterized in that the cover of the sintering carriage consists of two domes, the combustion air being conducted through the space between these domes from the blower to the burners, which are located on the sides of the cover, substantially horizontally. It has been previously found that by placing the burners in the side part of the ignition carriage and in a substantially horizontal position, the sinter goods can be made to ignite much more uniformly, and the sintered ore thus produced is of improved and more uniform quality than in the case where the burners are mounted on the cover itself, as is conventional. This is because the flames from burners mounted on the cover impinge at more or less right angles on the sinter goods and heat the point where they strike, but leave the surrounding area unheated. This also prevents any attempts to increase the output of the burners. Despite the fact that the drawbacks of burners mounted on the cover have long been known, horizontal burners on the sides have only been used in certain German designs. The main reason has been that the burners on the sides require air pipes of substantial length.

In the apparatus of the present invention the air pipes have been replaced with a cover structure having in its main parts two layers so that the air is introduced by a blower in the space between the two shells of the cover and thence conducted to the sides of the cover, from where it flows further to the burners.

BRIEF DESCRIPTION OF THE DRAWINGS

The invention is more closely illustrated in the following with reference to the attached drawing, wherein:

FIG. 2 shows the ignition frame of a belt sintering plant, and

FIGS. 3 and 4 present cross sections of the structure of FIG. 2.

DETAILED DESCRIPTION OF A PREFERRED EMBODIMENT

Figures 1, 1A:
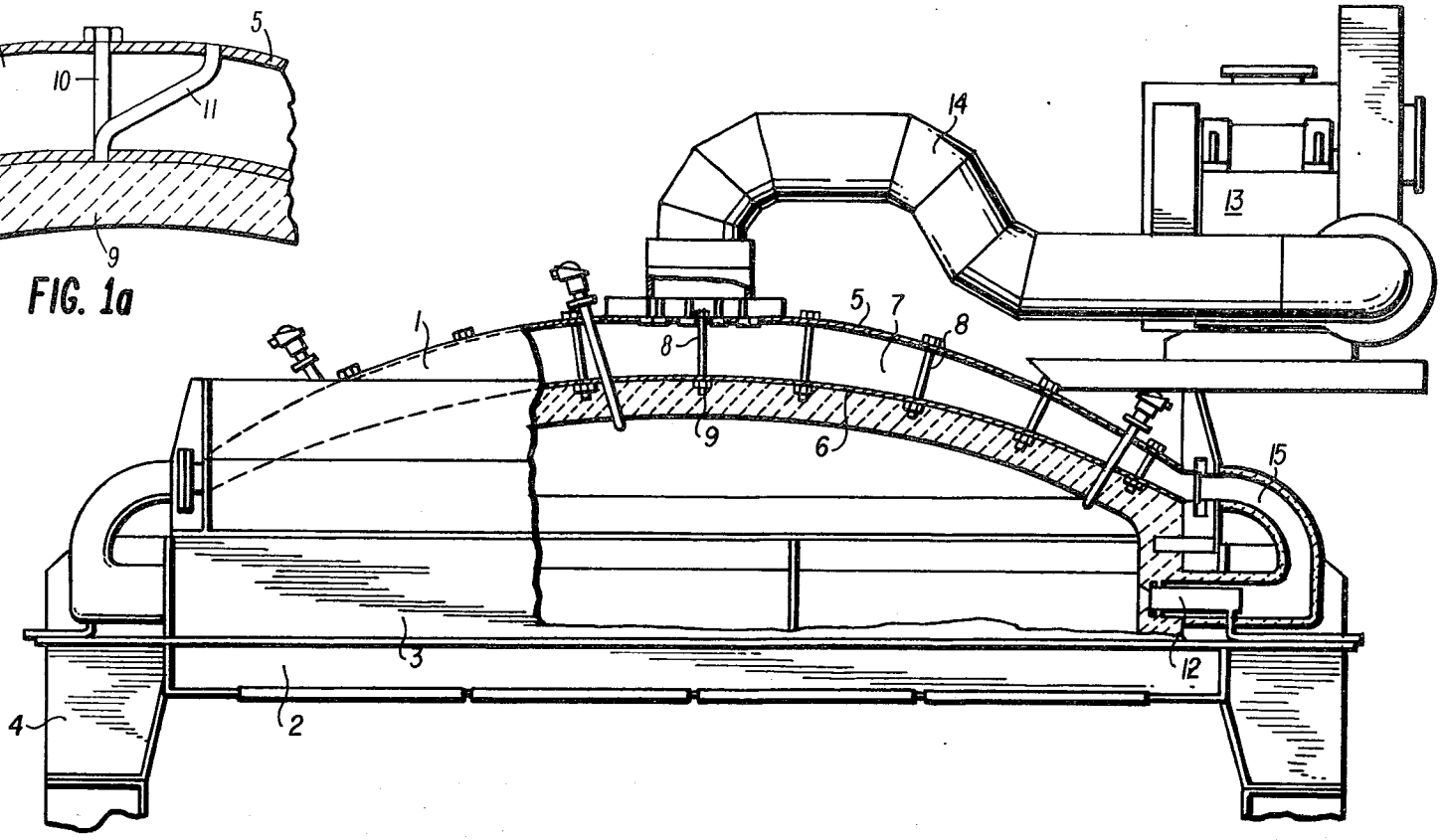
FIG. 1 shows the cover of a pan sintering plant in elevational view and partly sectioned.
FIG. 1*a* is a fragmentary cross-sectional detail of the cover of the invention.

The cover structure of the ignition carriage consists of the cover proper 1, the transverse beams 2, the sides 3 of the cover, and the legs 4, of which only the upper part has been depicted. The lower part carries wheels, on which the cover structure moves along rails, and the drive motors for these wheels. The transverse beams 2 at both ends of the carriage are made of heat-resistant steel. The cover is composed of two steel plates 5,6 bent into shape. Between the plates 5,6 there remains an air space 7. The plates 5,6 have been connected with each other at a sufficient number of points by bolts 8, which have a hollow interior in order to pass those gases through the cover which are generated in the refractory lining 9. Instead of said special bolts naturally separate bolts 10 and steam drain pipes 11 may be used, as has been done in the construction shown in FIG. 1*a*, in the central part of the cover.

The combustion air for the burners 12, which are of a conventional commercial type, is produced by means of a conventional centrifugal blower 13, which has been mounted in the upper part of the cover 1. From the blower 13, the pressurized air is conducted by one pipe 14 to the upper part of the cover 1 approximately in the centre of the cover 1. The air spreads from here into the space between the upper shell 5 and lower shell 6. As it moves slowly through the space 7 in the cover, the air is heated and cools the cover. From the side of the intermediate space there extend separate pipes 15 to each burner 12. The burners are located on two sides of the cover 3, equally spaced and horizontally. During the initial phase of the ignition the burners 12 are operated at full capacity, whereafter the power supplied by the burners 12 is substantially reduced so that the flames of the burners, which extend past the central line of the cover at full output, become short, and they ensure proper ignition of the sinter goods in the side areas too.

By the construction described above an apparatus is obtained which produces sintered ore characterized by high homogeneity and high quality. In addition, the following remarkable advantages are gained with the new cover design. The service life of the cover increases considerably since the main load-bearing structure is the outer shell, which is cooled by air on both sides. It is possible to use a lighter cover construction and to decrease the thickness of the course of refractory materials, whereby the cover becomes easier to move and is not subject to distortion. The cover is absolutely tight and even if the inner cover should develop cracks, no smoke can escape there-through into the sintering hall atmosphere. The efficiency of the sintering plant increases because preheated air is obtained and the heat transfer to the environment is reduced which also contributes to better working conditions in the sintering plant.

Referring now to FIGS. 2–4, the ignition frame has been provided with a double dome 24, 26, 31, the combustion air required by the burners 23 and by the sintering process, which is introduced via the entry duct 27, being heated in the interspace 25 of the domes. In the design suggested here the ignition field has furthermore been divided into two chambers in the direction of travel of the belt 21. In the first zone 24 the burners 23 make the surface of the sinter mass 21 incandescent; the burners 23 have been connected with the interspace 25 by means of air ducts 30. In the second zone 31 the final sintering is effected by means of the hot combustion air, which is supplied by combustion air conduits 28 fitted with regulating valves 29. The flue gases 22 escape from the side of the belt opposite to the ignition frame.

The ignition frame operates simultaneously as a heat exchanger (recuperator). Therefore, with a given amount of energy, a higher ignition temperature is obtained. It is possible to use a sinter mass with a higher moisture content; the quantity of material which needs to be recycled becomes less, and the requisite amount of coke is reduced.

I claim:

1. In a cover for the ignition frame of a sintering apparatus wherein said cover includes sides, burners mounted substantially horizontally on the sides of the cover and means for supplying combustion air to said burners, the improvement comprising said combustion air supplying means including a blower and an intermediate, enclosed space arranged in said cover, a pipe connecting said blower to a central portion of said cover for communicating said blower with said space and insulated pipes connected to said burners and to said space adjacent the sides of said cover for communicating said space with said burners whereby combustion air is conducted from said blower via said space to the burners.

2. The improvement according to claim 1, wherein said cover comprises an inner and outer shell forming said space therebetween, said inner shell having a refractory lining on the innermost surface thereof.

3. The improvement according to claim 1, wherein said cover includes an upper portion, the extent of said space being substantially equivalent to said upper portion.

4. The improvement according to claim 1, wherein said burners are equally spaced along opposite sides of said cover, said burners being operable initially in a full capacity phase and subsequently in reduced capacity phase.

5. In a cover for the ignition frame of a sintering apparatus wherein said cover includes sides, burners mounted substantially horizontally on the sides of the cover and means for supplying combustion air to said burners, the improvement comprising said combustion air supplying means including a blower and an intermediate enclosed space arranged in said cover in communication with said blower and said burners for conducting combustion air from said blower via said space to said burners, said sintering apparatus further including a conveyor belt disposed beneath said cover, said conveyor belt having a direction of travel, said cover including an outer shell and two inner shells forming two of said spaces therebetween comprising first and second zones, said first zone being located in the direction of travel and containing said burners, said second zone being located upstream of said first zone relative to the direction of travel of said belt and containing pipes for communicating combustion air to said second zone.

6. In a cover for the ignition frame of a sintering apparatus wherein said cover includes sides, burners mounted substantially horizontally on the sides of the cover and means for supplying combustion air to said burners, the improvement comprising said combustion air supplying means including a blower and an intermediate enclosed space arranged in said cover in communication with said blower and said burners for conducting combustion air from said blower via said space to said burners, said cover comprising an inner and outer shell forming said space therebetween, said inner shell having a refractory lining on the innermost surface thereof and conduit means connected between said shells for passing gases emanating from said refractory lining through said shells to the exterior of said cover.

7. The improvement according to claim 6, wherein said conduit means comprise hollow rods connecting said shells to each other.

* * * * *